United States Patent [19]

Yasumi

[11] Patent Number: 4,884,907

[45] Date of Patent: Dec. 5, 1989

[54] MECHANISM FOR SHIFTING THE TRACK POSITION OF A MULTI-TRACK INK RIBBON IN A PRINTER

[75] Inventor: Yoshiyuki Yasumi, Iwate, Japan

[73] Assignee: Alps Electric Co., Ltd., Japan

[21] Appl. No.: 282,920

[22] Filed: Dec. 6, 1988

Related U.S. Application Data

[63] Continuation of Ser. No. 86,371, Aug. 17, 1987, abandoned.

[30] Foreign Application Priority Data

Oct. 27, 1986 [JP] Japan ..... 61-163554

[51] Int. Cl.[4] ..... B41J 35/16

[52] U.S. Cl. ..... 400/216.1; 400/208; 400/240; 400/240.4

[58] Field of Search ..... 400/194, 195, 196, 196.1, 400/207, 208, 208.1, 212, 215.3, 216.1, 229, 240, 240.4

[56] References Cited

U.S. PATENT DOCUMENTS

| | | | |
|---|---|---|---|
| 4,236,839 | 12/1980 | Mueller | 400/216.1 |
| 4,247,210 | 1/1981 | Kacmarcik et al. | 400/208 X |
| 4,303,345 | 12/1981 | Lada | 400/208 X |
| 4,364,679 | 12/1982 | Longrod et al. | 400/212 |
| 4,407,595 | 10/1983 | Gershnow | 400/212 |
| 4,423,973 | 1/1984 | Theilen | 400/212 X |
| 4,502,802 | 3/1985 | Kuzuya | 400/216.1 X |
| 4,563,100 | 1/1986 | Hamamichi | 400/208 |
| 4,693,619 | 9/1987 | Ishii et al. | 400/216.1 X |
| 4,697,942 | 10/1987 | Yagi et al. | 400/208 |

FOREIGN PATENT DOCUMENTS

| | | | |
|---|---|---|---|
| 0059923 | 9/1982 | European Pat. Off. | 400/216.1 |
| 0016881 | 1/1983 | Japan | 400/212 |
| 0084788 | 5/1983 | Japan | 400/216.1 |
| 0017608 | 1/1984 | Japan . | |
| 0176084 | 10/1984 | Japan . | |
| 0182773 | 10/1984 | Japan . | |
| 0215888 | 12/1984 | Japan | 400/240.4 |
| 0078685 | 4/1986 | Japan | 400/216.1 |
| 2029327 | 3/1980 | United Kingdom | 400/240.4 |

*Primary Examiner*—Ernest T. Wright, Jr.
*Attorney, Agent, or Firm*—Guy W. Shoup

[57] ABSTRACT

A ribbon selecting mechanism for use with a printer comprising a ribbon cassette table on which a ribbon cassette for housing a ribbon is mounted opposite to a platen, said ribbon having plural color tracks formed thereon in the width direction thereof, a carriage movable along the platen, support arms each pivoted on the ribbon cassette table and the carriage at the upper and lower ends thereof to support the ribbon cassette table above the carriage, a drive mechanism having a drive plate to move the ribbon cassette table in the width direction of the ribbon, and a detent mechanism for stopping the drive plate at any of plural positions to oppose one of the plural color tracks to the platen.

3 Claims, 3 Drawing Sheets

MECHANISM FOR SHIFTING THE TRACK POSITION OF A MULTI-TRACK INK RIBBON IN A PRINTER

This application is a continuation of application Ser. No. 086,371, filed Aug. 17, 1987, now abandoned.

BACKGROUND OF THE INVENTION

1. Field of the Invention

The present invention relates to a ribbon selecting mechanism for use with the printer wherein a ribbon on which plural color tracks are formed in the width direction of the ribbon is moved in the width direction thereof in order to select one of the plural color tracks.

2. Prior Art

Printers provided with ribbon cassettes have been often used as output mechanisms for various kinds of information machines.

In the case of those printers which carry out their printing in plural colors, their ribbons have plural color tracks formed thereon in the width direction thereof.

Japanese Patent Preliminary Publications 59-176084 and -182773 propose mechanisms for selecting any of the color tracks on the ribbon according to colors to be printed to achieve color printing.

In the case of these conventional mechanisms, a carriage on which a printing head is mounted is made freely movable in parallel to a platen, a ribbon cassette table is pivoted on the top of side supports by means of a rod parallel to the moving direction of the carriage, said side supports being formed by bending and erecting both sides of the carriage, a ribbon cassette in which a ribbon is housed is mounted on the ribbon cassette table, said ribbon having plural color tracks formed thereon in the width direction thereof, a part of the ribbon is arranged in run between the printing head and the platen, the ribbon cassette is made freely swingable round the rod at a same level as the platen, forward or backward rotation is transmitted from the output shaft of a stepping motor at the carriage to a sector gear fixed to the ribbon cassette table through a group of reduction gears, the ribbon cassette is driven to oppose an intended color track to the printing head, and the ribbon cassette and the ribbon cassette table are stopped by a detent mechanism to oppose the intended color track to the printing head, said detent mechanism being arranged at that portion of the carriage which is the nearest to the platen.

In the case of these conventional mechanisms, however, the ribbon cassette was swung by one rod to make the center of the platen coincident with the centerline of a desired color track on the ribbon. This made it necessary to project the supports formed by bending and erecting both sides of the carriage, the rod and the like sideward from both sides of the carriage, thereby causing the whole of this arrangement to be large-sized.

SUMMARY OF THE INVENTION

The present invention is therefore intended to eliminate the above-mentioned drawback.

The object of the present invention is to provide a selection mechanism small in size and simple in construction.

A ribbon selecting mechanism for use with the printer according to the present invention comprises a ribbon cassette table on which a ribbon cassette for housing a ribbon therein is mounted opposite to a platen, said ribbon having plural color tracks formed thereon in the width direction thereof, a carriage movable along the platen, support arms each pivoted on the ribbon cassette table and the carriage at the upper and lower ends thereof by means of rods parallel to the moving direction of the carriage to support the ribbon cassette table above the carriage, a drive mechanism having a drive plate supported freely reciprocatable by the carriage to move the ribbon cassette table in the width direction of the ribbon at the upper end thereof, and a detent mechanism for stopping the drive plate at either of plural positions to oppose one of the color tracks to the platen.

According to the present invention, the drive plate can be moved together with the ribbon cassette table and the ribbon cassette to any of the color track positions by means of the drive mechanism and the cassette table can be stopped at a position by means of the detent mechanism to oppose an intended color track on the ribbon to the platen and the printing head.

The ribbon cassette table is supported by the drive mechanism at the front portion thereof and also supported in a freely swingable fashion by the support arms at the back portion thereof, said support arms being pivoted on the carriage at the lower end thereof and on the ribbon cassette table at the upper end thereof. According to the present invention, therefore, the ribbon cassette table and the ribbon cassette are made freely movable on a plane perpendicular to the axial direction of the platen but in a range in which the ribbon cassette table can move relative to the support arms. The drive plate is moved to move the ribbon in the ribbon cassette, which is also moving along the platen, in the width direction of the ribbon and then stopped when an intended color track on the ribbon is selected.

Further, it is not needed that the ribbon cassette table is supported by both sides of the carriage. When the support arms and drive mechanism are located under the ribbon cassette table, therefore, none of the mechanisms for supporting the ribbon cassette table protrudes sideward from both sides of the ribbon cassette table, thereby enabling the whole of the device to be made small in size and simple in construction.

DETAILED DESCRIPTION OF THE PREFERRED EMBODIMENT

An embodiment of the present invention will be described with reference to FIGS. 1 through 7.

Figure 1:
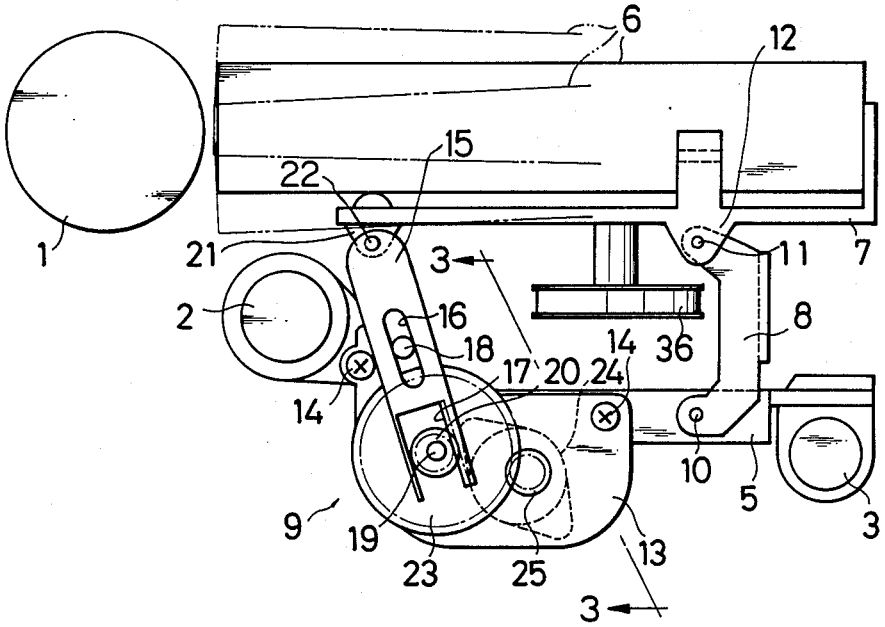
FIG. 1 is a side view showing an example of the ribbon selecting mechanism for use with the printer according to the present invention.
Figure 2:
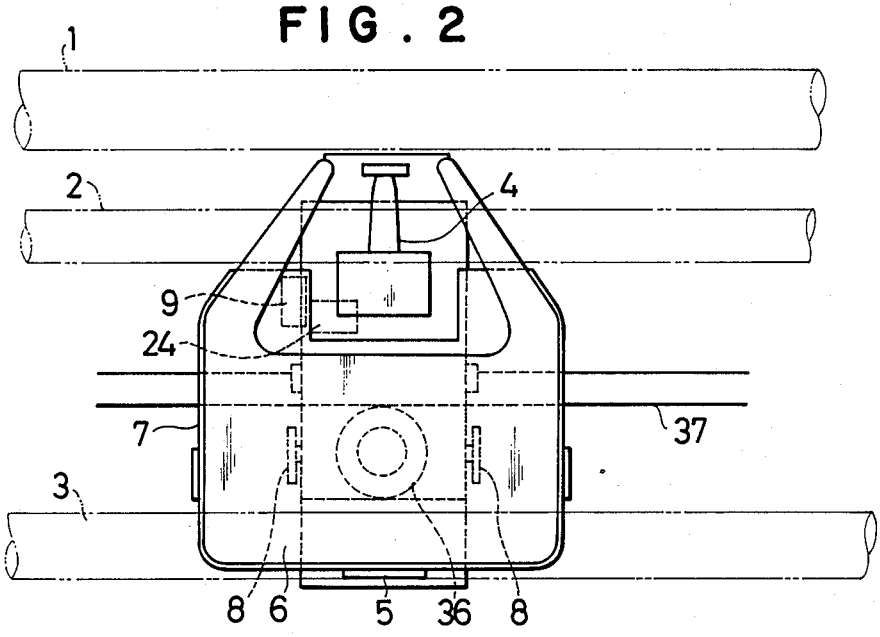
FIG. 2 is a plan view showing the ribbon selecting mechanism partly cut out.

FIGS. 1 and 2 show the whole of an embodiment of the present invention, in which numeral 1 represents a long freely-rotatable platen. Two guide rods 2 and 3 are bridged, parallel to the platen 1, of the printer and a carriage 5 on which a printing head 4 is mounted is freely reciprocated on the guide rods 2 and 3. A ribbon cassette table 7 on which a ribbon cassette 6 is mounted is supported above the carriage 5 by means of a pair of support arms 8 attached to both sides of the carriage 5 and also by means of a drive mechanism 9. Each of the support arms 8 is shaped like a fallen U and they are positioned at the back of the carriage 5 (or most remote from the platen 1). Each of them is pivoted on the carriage 5 at the lower end thereof by means of a rod 10 parallel to the platen 1, while on a bracket 12 at the upper end thereof by means of a rod 11 parallel to the platen 1, said bracket 12 being projected downward from the underside of the ribbon cassette table 7. The ribbon cassette table 7 is therefore supported by two pivot points or the rods 10 and 11 at the back thereof and it is allowed to freely move on a plane perpendicular to the axial direction of the platen 1 over a range allowed by those relative movements between the carriage 5 and the support arm 8 and between the support arm 8 and the ribbon cassette table 7.

Figure 5:
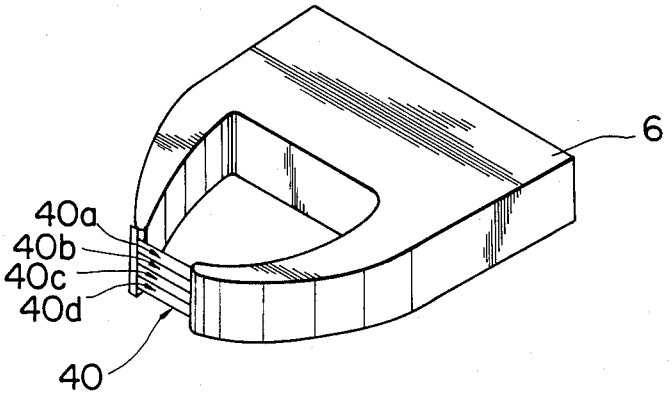
FIG. 5 shows a ribbon cassette having plural color tracks as used in the printer.
Figure 7:
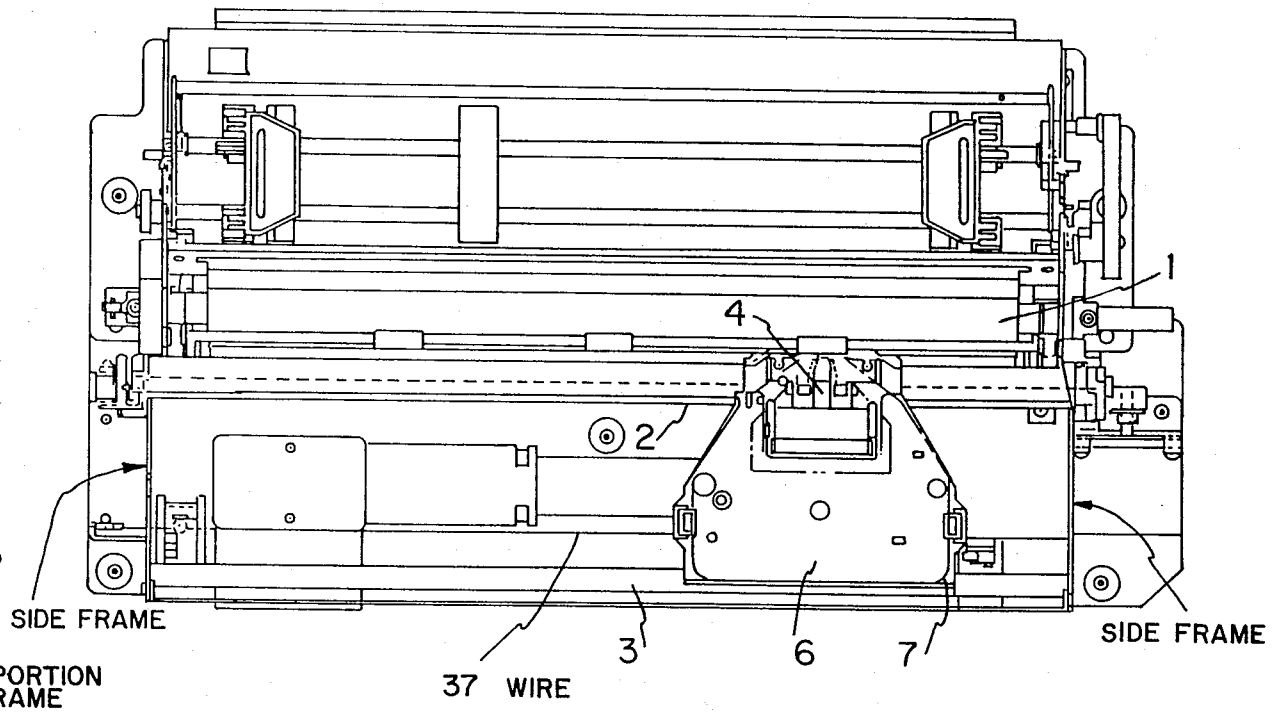
FIGS. 6 and 7 show the side frame and top view of the printer respectively.
Figure 6:
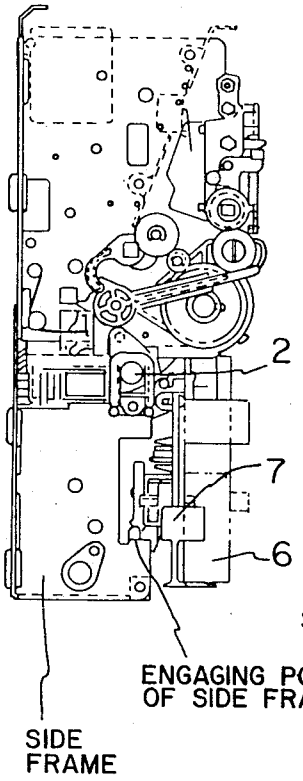

The drive mechanism 9 cooperates with the ribbon cassette table 7 to support the ribbon cassette 6 and it also moves the ribbon cassette table 7, which can be freely moved on a plane taking the two points 10, 11 as its pivot points, in a predetermined direction to move a ribbon 40 (as shown in FIG. 5) in the ribbon cassette 6 in the width direction of the ribbon 40 relative to the platen 1. The drive mechanism 9 is positioned under the ribbon cassette table 7. A stay 13 to which it is attached is fixed to the carriage 5 by means of fastening screws 14. A drive plate 15 for driving the ribbon cassette table 7 in the width direction of the ribbon 40 is attached, freely reciprocatable in a predetermined direction, to the stay 13. More specifically, the long drive plate 15 is provided with a guide slot 16 at the upper portion thereof and an internal rack 17 at the lower portion thereof. The guide slot 16 receives a guide pin 18 projected, parallel to the rod 10, from the stay 13 and the internal rack 17 is engaged with a drive gear 20 which is freely rotatably fitted onto a rod 19 projected, parallel to the rod 10, from the stay 13, thereby enabling the drive plate 15 to freely reciprocate along a line which extends through the guide pin 18 and the rod 19. The upper end of the drive plate 15 is hinged to a bracket 21 projected downward from the underside of the ribbon cassette table 7 by means of a pin 22. The moving direction of this drive plate 15 is related to the swinging range of the support arms 8 around the rod 10 and also the swinging range of the ribbon cassette table 7 around the rod 11. More specifically, the drive plate 15 is moved up and down between a position where the top color track 40*a* on the ribbon 40 housed in the ribbon cassette 6 is correctly positioned relative to the platen 1 and the printing head 4 and another position where the bottom color track 40*d* on the ribbon 40 is correctly positioned relative to the platen 1 and the printing head 4. The drive gear 20 is provided with a transmission gear 23 which coaxially rotates with the drive gear 20 and which is engaged with an output gear 25 which is driven by a stepping motor 24. This stepping motor 24 is fixed to the stay 13. When the stepping motor 24 is rotated forward or backward, the drive gear 20 is rotated forward or backward through the output gear 25 and the transmission gear 23 to move the drive plate 15 up or down via the internal rack 17.

Figure 3:
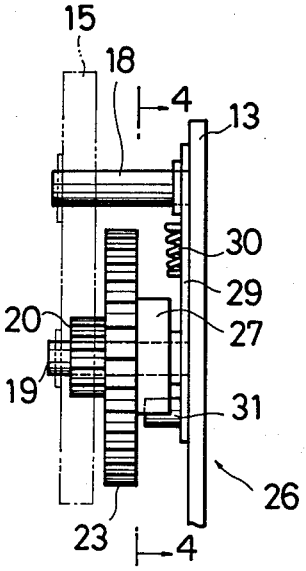
FIG. 3 shows the ribbon selecting mechanism viewed from a direction shown by line 3—3 in FIG. 1.
Figure 4:
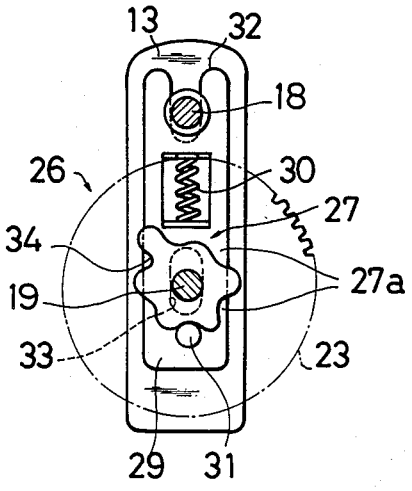
FIG. 4 is a sectional view taken along a line 4—4 in FIG. 3.

FIG. 4, which is a view from line 4—4 of FIG. 3, shows detent mechanism 26 for holding the drive plate 15 at a selected color track position and which is associated directly with the drive mechanism 9. Namely, a detent cam 27 which coaxially rotates with the transmission gear 23 is provided on that side of the transmission gear 23 which faces the drive gear 20, and a detent plate 29 is provided on that side of the stay 13 which faces the detent cam 27 so as to freely move in parallel to the drive plate 15. The detent plate 29 is urged upward by a compression spring 30 and a detent post 31 is projected from the lower end portion of the detent plate 29 to engage plural recesses 27*a* of the detent cam 27. A deep recess 32 and a slot 33 of the detent plate 29 loosely receive the guide pin 18 and the rod 19, respectively, to enable the detent plate 29 to freely move up and down. When the number of the color tracks 40*a*–40*d* on the ribbon 40 is four, for example, the detent cam 27 is provided with four recesses 27*a* to correspond to those rotating angles of the drive gear 20 which are needed to move each of the color tracks 40*a*, 40*b*, 40*c*, 40*d* on the ribbon 40 to its correct position. When the state in which either the top or bottom color track 40*a*, 40*d* on the ribbon 40 is opposed to the platen 1 and the printing head 4 is deemed to be in an initial position, a stopper 34 for engaging the detent post 31 to prevent the detent cam 27 from further rotating is formed outside the recess 27*a* which corresponds to the initial position.

A ribbon winding pulley 36 is freely rotatably attached to the underside of the ribbon cassette table 7 in the vicinity of the support arm 8. A wire 37 whose both ends are fixed to the frame of the printer is wound one time around the ribbon winding pulley 36, as shown in FIG. 2, and when the carriage 5 moves, the ribbon winding pulley 36 around which the wire 37 is wound one time is rotated to wind the ribbon 40 housed in the ribbon cassette 6.

When a printing instruction is issued to select a specific color track of the plural color tracks 40*a*–40*d* on the ribbon 40, a drive pulse is first given to the stepping motor 24 to return the drive plate 15 to the initial position, the detent cam 27 is rotated anti-clockwise in FIG. 4 through the output and transmission gears 25 and 23 to engage its stopper 34 with the detent post 31, and when the stopper 34 is engaged with the detent post 31, the stepping motor 24 is temporarily stopped. A drive pulse is then given to the stepping motor 24 to swing the drive plate 15 from the initial position to a position where a recess 27*a* of the detent cam 27 which corresponds to the selected color track 40*a*, 40*b*, 40*c* or 40*d* is engaged with the detent post 31, the stepping motor 24 is rotated, this rotation is transmitted to the guide pin 18 for the drive plate 15 through the output, transmission and drive gears 25, 23 and 20, and the drive plate 15 is guided and moved by the guide pin 18 and the rod 19. When the selected color track 40*a*, 40*b*, 40*c* or 40*d* reaches its correct position opposite to the platen 1 and the printing head 4, the stepping motor 24 is switched off to stop its rotation, the detent post 31 of the detent mechanism 26 is engaged with the selected recess 27*a* of the detent cam 27, and the ribbon cassette 6, drive plate 15 and the like are thus prevented from lowering because of their weights to thereby hold the selected color track 40*a*, 40*b*, 40*c*, or 40*d* at the correct position even after the stepping motor 24 is switched off.

When the drive plate 14 is moved, the detent cam 27 is also rotated clockwise in FIG. 2 from the initial position. When the detent post 31 gets over a mountain between two recesses 27*a*, the detent cam 27 is rotated against the compression spring 30 by which the detent plate 29 is urged upward.

When the selected color track 40*a*, 40*b*, 40*c* or 40*d* corresponds to the initial position, the drive plate 15 is returned to the initial position and the color track 40*a*, 40*b*, 40*c* or 40*d* is then selected without turning on the stepping motor 24.

When the color track 40*a*, 40*b*, 40*c* or 40*d* to be selected is to be changed, it can be achieved by appropriately combining the returning of the drive plate 15 to the initial position with the selecting of the recesses 27*a* of the detent cam 27.

The support arm 8 and the drive mechanism 9 are located under the ribbon cassette table 7 without projecting sidewards from under the ribbon cassette table 7. Therefore, the whole of this arrangement including the ribbon cassette table 7 can be smaller-sized and simpler in construction.

The ribbon winding pulley 36 is arranged near the support arm 8. Even when the ribbon cassette table 7 is moved to any of the positions to select one of the color tracks 40*a*, 40*b*, 40*c*, 40*d* on the ribbon 40, therefore, the ribbon winding pulley 36 will move only a very small amount and the wire 37 which is wound around the ribbon winding pulley 36 can be thus held substantially straight. Therefore, the impact added to the wire 37 when the carriage 5 is moved can be made smaller.

It should be understood that the present invention is not limited to the above-described embodiment but various changes and modifications can be made without departing from the scope and spirit of the present invention.

I claim:

1. In a ribbon track selecting mechanism for use with a printer having a ribbon cassette table with a ribbon cassette supported on an upper side thereof, the ribbon cassette containing a ribbon on a front side thereof facing a platen, wherein the ribbon is provided with a plurality of color tracks extending in a length direction of the ribbon and arranged in order vertically in a width direction of the ribbon, a carriage movable in a longitudinal direction along the platen, wherein the ribbon cassette table is supported vertically above the carriage and is shiftable by the ribbon track selecting mechanism in a vertical direction perpendicular to the longitudinal direction, in order to shift a selected one of the color tracks of the ribbon to a printing positon in front of the platen;

the improvement wherein said ribbon track selecting mechanism comprises:

a pair of support arms oriented in the vertical direction having one of their ends pivotally mounted to opposing lateral sides of said ribbon cassette table in the longitudinal direction and positioned toward a rear side of said ribbon cassette table remote from said platen, and having the other of their ends pivotally supported on said carriage, wherein said support arms may pivot freely to support movement of said rear side of said ribbon cassette table in the vertical direction;

ribbon driving means mounted on a bottom side of said ribbon cassette table toward the rear side thereof adjacent said support arms, said ribbon driving means being drivingly connected to said ribbon cassette;

a drive mechanism including a drive plate having one end pivotally mounted to a front side of said ribbon cassette table toward said platen, and a stepping motor mounted on said carriage below said ribbon cassette table and driving a drive gear engaged with engagement means on the other end of said drive plate, wherein said one end of said drive plate on the front side and said one ends of said support arms on the rear side of said ribbon cassette table define a plane which is selectively shiftable in the vertical direction by said drive mechanism to bring the selected one of the color tracks of the ribbon in said ribbon cassette to the printing position; and a detent mechanism for stopping and holding said drive plate in selected shift positions corresponding to positioning the color tracks, respectively, at the printing position, said detent mechanism including a detent cam rotatable on an axis together with said drive gear and having a cam surface formed with detent recesses corresponding to the selected shift positions of the color tracks, and a detent member for engaging in the corresponding one of said detent recesses of said detent cam at each selected shift position.

2. A ribbon track selecting mechanism according to claim 1, wherein said engagement means on the other end of said drive plate is a linear rack engaged with said drive gear.

3. A ribbon track selecting mechanism according to claim 1, wherein said detent member includes a pin supported on a slidable plate and projecting in a direction along the detent cam axis of engagement in said detent recesses on one side of said axis, and biasing means connected between said slidable plate and a portion of said carriage for biasing said pin into said detent recesses.

* * * * *